US005470381A

United States Patent [19]

Kato et al.

[11] Patent Number: 5,470,381

[45] Date of Patent: Nov. 28, 1995

[54] ELECTROLESS GOLD PLATING SOLUTION

[75] Inventors: Masaru Kato; Yutaka Yazawa; Shigetaka Hoshino, all of Soka, Japan

[73] Assignee: Kanto Kagaku Kabushiki Kaisha, Tokyo, Japan

[21] Appl. No.: 256,369

[22] PCT Filed: Nov. 25, 1992

[86] PCT No.: PCT/JP92/01538

§ 371 Date: Jul. 22, 1994

§ 102(e) Date: Jul. 22, 1994

[87] PCT Pub. No.: WO94/12686

PCT Pub. Date: Jun. 9, 1994

[51] Int. Cl.[6] ..... C23C 18/44

[52] U.S. Cl. ..... 106/1.23; 106/1.26

[58] Field of Search ..... 106/1.26, 1.23

[56] References Cited

U.S. PATENT DOCUMENTS

| | | | |
|---|---|---|---|
| 3,697,296 | 10/1972 | Bellis | 106/1.26 |
| 3,700,469 | 10/1972 | Okinaka | 106/1.26 |
| 3,977,884 | 8/1976 | Gulla et al. | 427/304 |
| 4,142,902 | 3/1979 | Burke et al. | 106/1.23 |
| 4,792,469 | 12/1988 | Saito et al. | 106/1.26 |
| 4,804,559 | 2/1989 | Ushio et al. | 106/1.05 |
| 4,830,668 | 5/1989 | Wundt et al. | 106/1.26 |
| 4,880,464 | 11/1989 | Ushio et al. | 106/1.05 |
| 4,913,787 | 4/1990 | Kiso | 106/1.26 |
| 4,985,076 | 1/1991 | Iacovangelo | 106/1.26 |
| 5,130,168 | 7/1992 | Mathe et al. | 106/1.26 |
| 5,232,492 | 8/1993 | Krulik et al. | 106/1.26 |
| 5,258,062 | 11/1993 | Nakazawa et al. | 106/1.26 |
| 5,338,343 | 8/1994 | Kroll et al. | 106/1.26 |
| 5,364,460 | 11/1994 | Morimoto et al. | 106/1.26 |

FOREIGN PATENT DOCUMENTS

| | | |
|---|---|---|
| 0268732 | 1/1988 | European Pat. Off. . |
| 37-2955 | 5/1962 | Japan . |
| 62-99477 | 5/1962 | Japan . |
| 51-92738 | 8/1976 | Japan . |
| 55-51027 | 12/1980 | Japan . |
| 56-108869 | 8/1981 | Japan . |
| 58-19468 | 2/1983 | Japan . |
| 61-253376 | 11/1986 | Japan . |
| 63-137178 | 6/1988 | Japan . |
| 1-191782 | 8/1989 | Japan . |
| 4-350172 | 12/1992 | Japan . |
| 2114159 | 8/1983 | United Kingdom . |

*Primary Examiner*—Anthony Green
*Attorney, Agent, or Firm*—Birch, Stewart, Kolasch & Birch

[57] ABSTRACT

An electroless gold plating solution comprising an aqueous solution containing as ingredients (a) chloroauric (III) acid or a salt thereof or a sulfite or thiosulfate gold (I) complex salt as a gold source, (b) an alkali metal or ammonium sulfite or thiosulfate, (c) ascorbic acid or a salt thereof and (d) a pH buffer, characterized in that (e) a compound selected from 2-mercaptobenzothiazole, 6-ethoxy-2-mercaptobenzothiazole, 2-mercaptobenzimidazole, 2-mercaptobenzoxazole and salts thereof, and optionally (f) an alkylamine compound are further incorporated. The solution prevents the bath made up thereof from forming any precipitate during the storage and usage of the bath and the bath can be stably used for long periods of time. Furthermore, the bath gives a significantly high plating rate, which does not decrease even at high bath loads. Thus the bath renders it possible to plate a number of substrate items within a short period of time and also to perform thick plating within a short period of time.

7 Claims, 1 Drawing Sheet

ELECTROLESS GOLD PLATING SOLUTION

FIELD OF THE INDUSTRIAL APPLICATION

This invention relates to an electroless gold plating solution using chloroauric (III) acid or a salt thereof or a sulfite or thiosulfate gold (I) complex salt as a gold source.

BACKGROUND ART

Due to its excellent functional characteristics, electroless gold plating has been widely used in the field of electronic industry where plating of complex fine circuits, isolated parts with difficult access to leads, etc. is needed. As common electroless gold plating solutions there have been heretofore used those containing. cyanides of strong toxicity as a gold (I) ion-complexing agent, which are usually used at high temperatures under strongly alkaline conditions. As a result, where they are used in such applications as mentioned above, various problems are encountered, for example, separation of resists used for masking circuits or corrosion of ceramic base materials by alkalis. Furthermore, cyanide-containing electroless gold plating baths are extremely high in toxicity and thereby cause problems in their handling, storing and controlling as well as with regard to the safety of working environments and the economy of waste liquid disposal.

On the other hand, as a representative of gold plating solutions using no cyanides there has been known a gold plating solution using a chloroaurate (III) as a gold source (see, for example, U.S. Pat. No. 4,142,902 and GB, A, 114159). This chloroaurate (III) based gold plating solution, where a gold complex salt is formed from the chloroaurate (III) and a sulfite or thiosulfate as a further ingredient, has been put into practical use as cyanide-free plating solution.

In addition those plating solutions using sodium chloroaurate (III) or sodium gold (I) thiosulfate as a gold source and containing sodium sulfite and thiourea as further ingredients have been known from U.S. Pat. Nos. 4,804,559 and 4,880,464. With the plating solutions described in these U.S. Patents, plating, although possible under weakly acidic conditions, proceeds at a low rate and high temperatures are required to raise the plating rate. Furthermore, although continuous plating is possible therewith, plating has to be performed for a long period of time even at a temperature of as high as 80° C. if a film thickness of 5 μm or more is to be achieved.

The present inventors have previously provided an improvement in electroless gold plating solutions with the above-described chloroaurate (III) as a gold source, which improvement comprises using ascorbic acid as a reducing ingredient (see Japanese published unexamined patent application No. 1-191782, JP, A, 1-191782). These improved electroless gold plating solutions containing chloroauric (III) acid or a salt thereof, an alkali metal or ammonium sulfite or thiosulfate and ascorbic acid or a salt thereof as ingredients provide practical plating rates at low temperatures under approximately neutral pH conditions. Also, they are advantageous in that they can be used as a gold plating solution for fine circuits or leads on printed plate boards etc. without causing corrosion of ceramic substrates or separation of masking resists.

Even these electroless gold plating solutions, however, are not satisfactory, since they present safety problems yet to be solved, for example, formation of small quantities of precipitate during their use or precipitation of fine particles of gold during their storage subsequent to their make up.

Reasons for the instability of those gold plating baths using a sulfite gold (I) complex salt or thiosulfate gold (I) complex salt as a gold source as well as of those gold plating baths where a gold complex is formed in situ from a chloroaurate (III) and sulfurous or thiosulfuric acid have not been demonstrably elucidated but might be as follows:

Thus, for example, it might be that autoxidation and concentration reduction during storage or plating of such easily oxidizable ingredients as sulfite or thiosulfate ions lead to a change in the equilibrium state of the solution to instabilize the gold complex with the result that the gold activity is increased to render the bath liable to be decomposed. Furthermore, it might be that possible contamination with traces of such metal ions as would enhance the oxidizing activity of the ascorbic acid lead to formation of fine particles of gold with these ions as nuclei, which in turn accelerates decomposition of the bath.

OBJECTS OF THE INVENTION

An object of the present invention is to provide an electroless gold plating solution of excellent stability.

Another object of the present invention is to provide an electroless gold plating solution with which plating can be performed at a high rate under moderate operating conditions at pH's in the vicinity of the neutral point and at relatively low temperatures and which is excellent also in respect of stability.

DISCLOSURE OF THE INVENTION

As a result of extensive studies made with the aim at ameliorating the stability of electroless gold plating solutions, the present inventors have now found that by incorporating a compound selected from 2-mercaptobenzothiazole, 6-ethoxy-2-mercaptobenzothiazole, 2-mercaptobenzimidazole, 2-mercaptobenzoxazole and salts thereof into an electroless gold plating solution comprising an aqueous solution containing as ingredients (a) chloroauric (III) acid or a salt thereof or a sulfite or thiosulfate gold (I) complex salt as a gold source, (b) an alkali metal or ammonium sulfite or thiosulfate, (c) ascorbic acid or a salt thereof and (d) a pH buffer the stability of the plating solution during storage or plating can be significantly enhanced and the stability of the plating solution during its long-term use and storage can be improved.

Furthermore, as a result of extensive studies made with the object of ameliorating the plating rate while securing the stability of electroless gold plating solutions, the present inventors have also found that by incorporating, into an electroless gold plating solution comprising an aqueous solution containing as ingredients (a) chloroauric (III) acid or a salt thereof or a sulfite or thiosulfate gold (I) complex salt as a gold source, (b) an alkali metal or ammonium sulfite or thiosulfate, (c) ascorbic acid or a salt thereof and (d) a pH buffer, both (e) a compound selected from 2-mercaptobenzothiazole, 6-ethoxy-2-mercaptobenzothiazole, 2-mercaptobenzimidazole, 2-mercaptobenzoxazole and salts thereof and (f) a compound selected from alkylamine compounds and the sulfate and hydrochloride thereof, the objects can be achieved.

Thus, the present invention provides an electroless gold plating solution containing (a) chloroauric (III) acid or a salt thereof or a sulfite or thiosulfate gold (I) complex salt as a gold source, (b) an alkali metal or ammonium sulfite or thiosulfate, (c) ascorbic acid or a salt thereof, (d) a pH buffer and (e) a compound selected from 2-mercaptobenzothiazole, 6-ethoxy-2-mercaptobenzothiazole, 2-mercaptobenzimidazole, 2-mercaptobenzoxazole and salts thereof.

Furthermore, the present invention provides an electroless gold plating solution comprising an aqueous solution containing as ingredients (a) chloroauric (III) acid or a salt thereof or a sulfite or thiosulfate gold (I) complex salt as a gold source, (b) an alkali metal or ammonium sulfite or thiosulfate, (c) ascorbic acid or a salt thereof and (d) a pH buffer, wherein (e) a compound selected from 2-mercaptobenzothiazole, 6-ethoxy-2-mercaptobenzothiazole, 2-mercaptobenzimidazole, 2-mercaptobenzoxazole and salts thereof and (f) a compound selected from alkylamine compounds and the sulfate and hydrochloride thereof are further contained.

In the following will now be explained the present invention in greater detail.

Preferred embodiments of the electroless gold plating solution of the present invention may be illustrated as follows:

The solution will contain 0.001–0.10 moles/liter of gold salt, 0.01–1.0 moles/liter of sodium sulfite, 0.01–1.0 moles/liter of sodium thiosulfate, 0.01–1.0 moles/liter of sodium phosphate, 0.001–1.0 moles/liter of ascorbic acid or its sodium salt, $6\times10^{-7}$–$3\times10^{-3}$ moles/liter of 2-mercaptobenzothiazole, 6-ethoxy-2-mercaptobenzothiazole, 2-mercaptobenzimidazole or 2-mercaptobenzoxazole and 0.0001–0.05 moles/liter of alkylamine compound.

Examples of the alkylamine compounds and salts thereof described above include ethylenediamine, ethylenediamine hydrochloride, ethylenediamine sulfate, diethylenetriamine, triethylenetetramine, tetraethylenehexamine, 1,2-propanediamine, 1,3-propanediamine, ethanolamine, triethanolamine and hexamethylenetetramine.

As a result of studies made of the relationship between the composition of the electroless gold plating solution in accordance with the present invention and the plating rate and plating solution stability achieved therewith, the present inventors have made the following findings:

(1) The chloroauric (III) acid or its salts or the sulfite or thiosulfate gold (I) complex salts are used preferably in an amount of 0.001–0.1 moles/liter, and especially preferably in an amount of 0.005–0.05 moles/liter. With amounts of less than 0.001 moles/liter no plating rates of practical use are obtainable, and the use of amounts of more than 0.1 moles/liter tend to cause precipitation of the gold and hence is economically disadvantageous.

(2) With regard to the sulfite content, sodium sulfite, for example, is contained preferably in an amount of 0.01–1.0 moles/liter, especially preferably in an amount of 0.04–0.5 moles/liter. With the content of less than 0.01 moles/liter, the solution is unstable and liable to decomposition. The content of more than 1.0 moles/liter results in a significant decrease in the plating rate and therefore is not preferable in practice.

(3) With regard to the thiosulfate content, sodium thiosulfate, for example, is contained preferably in an amount of 0.01–1.0 moles/liter, especially preferably in an amount of 0.04–0.5 moles/liter. With the content of less than 0.01 moles/liter, the plating solution lacks stability and is liable to decomposition, while the content of more than 1.0 moles/liter does not show any noteworthy effects on plating reactions.

(4) A preferred example of the pH buffer is a buffer solution prepared from sodium hydrogen phosphate. Its content is preferably 0.01–1.0 moles/liter, especially preferably 0.05–0.5 moles/liter. The content of less than 0.01 moles/liter is liable to cause roughening of the resultant plate surface. No noteworthy effects can be expected with the content of more than 1.0 moles/liter.

(5) With regard to the ascorbic acid content, sodium ascorbate, for example, is contained preferably in an amount of 0.001–1.0 moles/liter, especially preferably in an amount of 0.01–0.5 moles/liter. With the content of less than 0.001 moles/liter the plating rate is low, while with the content of more than 1.0 moles/liter the plating solution becomes unstable and liable to undergo decomposition.

(6) The content of 2-mercaptobenzothiazole, 6-ethoxy-2-mercaptobenzothiazole, 2-mercaptobenzimidazole, 2-mercaptobenzoxazole or a derivative or salt thereof is preferably $6\times10^{-7}$–$3\times10^{-3}$ moles/liter, especially preferably $6\times10^{-6}$–$6\times10^{-5}$ moles/liter. The content of less than $6\times10^{-7}$ moles/liter is not preferred because it renders the plating solution unstable and liable to decomposition. The content of more than $3\times10^{-3}$ moles/liter is not preferred, either, because the plating rate becomes lower although the stability of the plating solution increases.

(7) In using the plating solution of the present invention, the pH is adjusted as appropriate within the limits which do not cause decomposition of the ingredients of the plating solution, using sulfuric acid or caustic soda solution. The preferred pH range is 5–9, especially 6–8.

(8) The operative range of temperatures for the plating solution of the present invention may be 50°–80° C., preferably 50°–70° C., more preferably 55°–65° C. That plating is possible at such low temperatures is especially convenient in those cases where the substrate to be plated is an article not resistant to heat, and also brings about excellent advantages, in respect of energy saving and operator's safety, which have never been attained with conventional electroless gold plating solutions.

EXAMPLES

In the following will now be illustrated the present invention in greater detail by way of examples including controls.

Example 1

An electroless gold plating solution (A) of the composition described below was used to prepare those solutions indicated below in Table 1 which contained 2-mercaptobenzothiazole at the different concentrations, i.e. 0.1 ppm, 0.5 ppm, 1.0 ppm and 5.0 ppm. Each of the solutions was tested for the stability during storage at room temperature. The results are shown in Table 1.

| Electroless gold plating solution (A) | |
|---|---|
| Sodium chloroaurate (III) | 2 g/L as gold |
| Sodium sulfite | 10 g/L |
| Sodium thiosulfate | 20 g/L |
| Sodium L-ascorbate | 40 g/L |
| Disodium hydrogen phosphate | 9 g/L |
| Sodium dihydrogen phosphate | 3 g/L |
| pH | 7.0 |

As can be seen from Table 1, in the bath containing no 2-mercaptobenzothiazole (control), a gold precipitate was found to form already as early as on day 2 after the make up of the bath. Thus the bath was so unstable that it was difficult to use it for a long period of time or to store it even for only a few days after the bath make-up.

In contrast, in the baths containing 2-mercaptobenzothiazole at 0.1 ppm, 0.5 ppm and 1.0 ppm (examples of the present invention), no gold precipitate was found to form for six days even in the 0.1 ppm-added bath and for thirty days in the 0.5 ppm- and 1.0 ppm-added baths. Thus, a remarkable improvement in stability was achieved over the additive-free bath, and long-term storage at room temperature was rendered possible. Furthermore, with the 5.0 ppm-added bath, further improved stability was attained, thus demonstrating that the higher the concentration of 2-mercaptobenzothiazole added the better the stability of the bath. From these examples, it can be seen that the electroless gold plating solution in accordance with the present invention is significantly effective in enhancing the stability of baths.

Example 2

Into the electroless gold plating solution (A) described in Example 1 was incorporated 2-mercaptobenzothiazole to the different concentrations indicated below in Table 2. Using each of the resultant solutions, a specimen to be plated, which was obtained by electrically plating a rolled nickel plate, 2 cm×2 cm in size and 0.1 mm in thickness, first with a 3 μm-thick nickel film and then with a 3μm-thick gold film, was plated for six hours with stirring at a bath load of 0.8 $dm^2/L$ and a temperature of 60° C. The results are shown in Table 2.

As can be seen from Table 2, in the 2-mercaptobenzothiazole-free bath (control), a small amount of gold precipitate began to form in about three hours, it thus being difficult to use the bath for six hours or longer.

In contrast, the 2-mercaptobenzothiazole-added baths (examples of the present invention) exhibited enhanced stability with no formation of gold precipitate observed within six hours of plating. With regard to the gold deposition rate, the 1 ppm or less-added baths exhibited much the same plating rate as with the additive-free bath. On the other hand, those baths to which 2.5 ppm or more was added tended to show a slightly decreased plating rate. Furthermore, plating was found to terminate in about three hours when the 5 ppm-added bath was used. There was observed no formation of gold precipitate or decomposition product.

From these examples, it can be seen that the electroless gold plating solution of the present invention containing the additive at suitable concentrations is significantly effective in enhancing the stability of the bath without lowering the deposition rate.

Example 3

An electroless gold plating solution (B) of the composition shown below as well as a gold plating solution consisting of the gold plating solution (B) having 2-mercaptobenzothiazole contained therein at 1 ppm was prepared. Using these solutions, plating was carried out for six hours with specimens of the .same type under the same plating conditions as in Example 2. After being allowed to stand overnight, the same (used) solutions were used to perform plating all under the same conditions on the following day. These plating operations were performed everyday over an overall period of three consecutive days.

| Electroless gold plating solution (B) | |
|---|---|
| Sodium chloroaurate (III) | 2.5 g/L as gold |

-continued

| Electroless gold plating solution (B) | |
|---|---|
| Sodium sulfite | 11 g/L |
| Sodium thiosulfate | 21 g/L |
| Sodium L-ascorbate | 40 g/L |
| Disodium hydrogen phosphate | 10 g/L |
| Sodium dihydrogen phosphate | 3 g/L |
| pH | 7.0 |

As a result, in the case of the 2-mercaptobenzothiazole-free bath, the six-hour plating on day 1 could be performed at a mean plating rate of 1.0 μm/hr. At a point of time when about three hours had lapsed after the start of plating on day 1, however, a precipitate of fine gold particles was observed to form in the plating solution. Furthermore, the gold precipitate was found to gradually increase during the subsequent overnight standing of the bath at room temperature, and formation of a large amount of precipitate was observed on the following day. Accordingly no plating was possible on and after day 2. In contrast, in the bath to which 1 ppm of 2-mercaptobenzothiazole had been added, no formation of decomposition products such as gold precipitate was observed during the three-day plating, and the three-day plating could be carried out with stability, although the daily repeated operation was accompanied by a decrease in the plating rate on the order of about 10%/day. The mean plating rates in the six-hour platings were 1.0 μm/hr on day 1, 0.91 μm/hr on day 2 and 0.80 μm/hr on day 3.

As can be seen from the afore-mentioned, it has been demonstrated that the incorporation of 2-mercaptobenzothiazole is significantly effective not only in enhancing the bath stability during plating, but also in preventing from decomposition during its storage the bath which has once been heated, thus rendering possible the long-term repeated use of the bath.

Example 4

The electroless gold plating solution (A) as described in Example 1 as well as a plating bath consisting of the gold plating solution (A) having 1 ppm of 2-mercaptobenzothiazole contained therein was prepared. Each of these plating baths was kept unused at room temperature over the indicated periods in Table 3.

Using a part of each of the plating solutions kept for the corresponding period of storage, a specimen to be plated, which was obtained by electrically plating a rolled nickel plate, 2 cm×2 cm in size and 0.1 mm in thickness, first with a 3 μm-thick nickel film and then with a 3 μm thick gold film, was plated with stirring at a bath load of 0.8 $dm^2/L$ and a temperature of 60° C. The plating solutions kept over the respective periods of storage were compared in respect of the plating rate and the appearance of the finished product. The results are shown in Table 3.

As can be seen from Table 3, in the 2-mercaptobenzothiazole-free bath (control) a large amount of gold precipitate formed in the bath already as early as in one week of storage, thus rendering it impossible to further continue plating operations. In contrast, in the bath to which 1 ppm of 2-mercaptobenzothiazole had been added (example of the present invention), any change including precipitate formation was not observed up until the twenty-eighth day. Plating with the bath stored for different periods showed that plating was possible with the 14-day-stored bath at a comparable plating rate to that with the freshly made up bath, and that plating was possible with the baths stored up to 28 days. Thus, with the 35-day-stored bath, a gold precipitate formed and no plating was possible. There was observed a tendency for the plating bath to begin to be slightly colored yellow on day 14 of storage, and for the coloration to be intensified with increasing periods of storage.

With regard to the state of plates achieved with the bath to which 1 ppm of 2-mercaptobenzothiazole was added, bright yellow, matted or semi-bright, uniform deposit films could be obtained, independently of periods of storage of the plating bath.

TABLE 1

| | Amount of 2-mercaptobenzothiazole added (ppm) | State of solution |
|---|---|---|
| Control | 0 | Gold precipitate formed on day 2 |
| Example of the present invention | 0.1 | Gold precipitate formed on day 6 |
| | 0.5 | Gold precipitate formed on day 30 |
| | 1.0 | Gold precipitate formed on day 30 |
| | 5.0 | Gold precipitate formed on day 45 |

TABLE 2

| | Amount of 2-mercapto-benzothiazole added (ppm) | Deposition rate (μm/hr) | State of bath |
|---|---|---|---|
| Control | 0 | 0.70 | Gold precipitate formed in 3 hrs |
| Example of the present invention | 0.1 | 0.70 | No precipitate formed during 6 hrs |
| | 0.5 | 0.72 | No precipitate formed during 6 hrs |
| | 1.0 | 0.72 | No precipitate formed during 6 hrs |
| | 2.5 | 0.67 | No precipitate formed during 6 hrs |
| | 5.0 | 0.67 | No precipitate formed during 6 hrs |

TABLE 3

| Composition of solution | Period of storage | Bath change during storage | Plating rate (μm/hr) |
|---|---|---|---|
| | Control | | |
| 2-mercapto-benzothiazole-free | Immediately after make up | — | 0.56 |
| | 7 days | Gold precipitate formed | No plating possible |
| | Example of the present invention | | |
| 2-mercapto-benzothiazole added in an amount of 1 ppm | Immediately after make up | — | 0.54 |
| | 1 day | No precipitate formed | 0.50 |
| | 7 days | No precipitate formed | 0.57 |
| | 14 days | No precipitate formed | 0.56 |
| | 21 days | No precipitate formed | 0.41 |
| | 28 days | No precipitate formed | 0.28 |
| | 35 days | Precipitate formed possible | No plating |

The electroless gold plating solution (A) as described in Example 1 was used to prepare those solutions as shown below in Table 4 which contained 6-ethoxy-2-mercaptobenzothiazole at the different concentrations, i.e. 0.5 ppm, 1.0 ppm, 2.5 ppm and 5.0 ppm. Each of the solutions was tested for the stability during storage at room temperature. The results are as shown in Table 4.

As can be seen from Table 4, in the bath (control) where no 6-ethoxy-2-mercaptobenzothiazole was contained, a gold precipitate was found to form already as early as on day 2 after the make up of the bath. Thus, the bath was so unstable that it was difficult to use it for a long period of time or to store it even for only a few days after the bath make-up.

In contrast, in the baths containing 6-ethoxy-2-mercaptobenzothiazole at 0.5 ppm, 1.0 ppm, 2.5 ppm and 5.0 ppm (examples of the present invention), no gold precipitate was found to form for six days even in the 0.5 ppm-added bath, for 15 days in the 1.0 ppm- and 2.5 ppm-added baths and for 30 days in the 5.0 ppm-added bath. Thus a remarkable improvement in stability was achieved over the additive-free bath, and long-term storage at room temperature was rendered possible. A tendency has also been found to exist that the higher the concentration of 6-ethoxy-2-mercaptobenzothiazole added the better the stability.

TABLE 4

| | Amount of 6-ethoxy-2-mercaptobenzothiazole added (ppm) | State of solution |
|---|---|---|
| Control | 0 | Gold precipitate formed on day 2 |
| Example of the present invention | 0.5 | Gold precipitate formed on day 6 |
| | 1.0 | Gold precipitate formed on day 15 |
| | 2.5 | Gold precipitate formed on day 15 |
| | 5.0 | Gold precipitate formed on day 30 |

Example 6

An electroless gold plating solution (C) of the composition described below was used to prepare those solutions as shown below in Table 5 which contained 2-mercaptobenzoxazole at the different concentrations, i.e. 50 ppm, 100 ppm, 250 ppm and 500 ppm. Each of these solutions was tested for the stability during storage at room temperature. The results are shown in Table 5.

| Electroless gold plating solution (C) | |
|---|---|
| Sodium gold (I) sulfite | 2 g/L as gold |
| Sodium sulfite | 10 g/L |
| Sodium thiosulfate | 25 g/L |
| Sodium L-ascorbate | 40 g/L |
| Disodium hydrogen phosphate | 9 g/L |
| Sodium dihydrogen phosphate | 3 g/L |
| pH | 7.0 |

found to form already as early as on day 3 after the make up of the bath. Thus, the bath was so unstable that it was difficult to use it for a long period of time or to store it even for only a few days after the bath make-up.

In contrast, in the baths containing 2-mercaptobenzoxazole at 50 ppm, 100 ppm, 250 ppm and 500 ppm (examples of the present invention), no gold precipitate was found to form for twenty days even in the 50 ppm-added bath and for thirty days in the 100 ppm-, 250 ppm- and 500 ppm-added baths. Thus a remarkable improvement in stability was achieved over the additive-free bath and long-term storage at room temperature was rendered possible. It was thus also demonstrated that the higher the concentration of 2-mercaptobenzoxazole added the better the stability of the bath.

TABLE 5

| | Amount of 2-mercaptobenzoxazole added (ppm) | State of solution |
|---|---|---|
| Control | 0 | Gold precipitate formed on day 3 |
| Example of the present invention | 50 | Gold precipitate formed on day 20 |
| | 100 | No gold precipitate formed during 30 days |
| | 250 | No gold precipitate formed during 30 days |
| | 500 | No gold precipitate formed during 30 days |

Example 7

An electroless gold plating solution (D) of the composition described below was prepared. Into this solution was incorporated 6-methoxy-2-mercaptobenzothiazole to the different concentrations, i.e. 0.5 ppm, 1 ppm, 2 ppm and 2.5 ppm. Using each of the resultant solutions, a specimen to be plated, which was obtained by electrically plating a rolled nickel plate, 2 cm×2 cm in size and 0.1 mm in thickness, first with a 3 μm-thick nickel film and then with a 3 μm-thick gold film, was plated for six hours with stirring at a bath load of 1.2 $dm^2/L$ and a temperature of 60° C. The results are shown in Table 6.

| Electroless gold plating solution (D) | |
|---|---|
| Sodium gold (I) sulfite | 2 g/L as gold |
| Sodium sulfite | 15 g/L |
| Sodium thiosulfate | 30 g/L |
| Sodium L-ascorbate | 40 g/L |
| Disodium hydrogen phosphate | 12 g/L |
| Sodium dihydrogen phosphate | 4 g/L |
| pH | 7.0 |

TABLE 6

| | Amount of 6-ethoxy-2-mercapto-benzothiazole added (ppm) | Deposition rate (μm/hr) | Bath change |
|---|---|---|---|
| Control | 0 | 0.65 | Gold precipitate formed in 3 hrs |
| Example of the present invention | 0.5 | 0.63 | No precipitate formed during 6 hrs |
| | 1.0 | 0.66 | No precipitate formed during 6 hrs |
| | 2.0 | 0.62 | No precipitate formed during 6 hrs |
| | 2.5 | 0.39 | No precipitate formed during 6 hrs |

As can be seen from Table 6, in the bath containing no 6-ethoxy-2-mercaptobenzothiazole (control), formation of a small amount of gold precipitate began in about three hours, it thus being difficult to use the bath for six hours or longer.

In contrast, the 6-ethoxy-2-mercaptobenzothiazole-added baths (examples of the present invention) exhibited remarkably enhanced stability with no formation of gold precipitates observed within the six hours of plating. With regard to the gold deposition rate, those baths containing the 6-ethoxy-2-mercaptobenzothiazole at 2 ppm or less exhibited much the same plating rate as with the additive-free bath (control), thus showing no plating rate reduction with increasing stability. The bath containing the 6-ethoxy-2-mercaptobenzothiazole at 2.5 ppm, however, showed a slightly decreased deposition rate.

With regard to the appearance of deposits, the additive-free bath (control) gave a matted deposit which was reddish yellow in color, whereas the deposits obtained in the examples of the present invention presented a better appearance in that they were semi-bright and bright yellow in color.

Example 8

An electroless gold plating solution (E) of the composition described below was prepared. Into this solution was incorporated 2-mercaptobenzoxazole to the different concentrations, i.e. 50 ppm, 100 ppm, 250 ppm and 500 ppm. Using each of the resultant solutions, a specimen to be plated, which was obtained by the same treatments as used for the preparation of the specimen in Example 3, was plated for six hours with stirring at a bath load of 0.8 $dm^2/L$ and a temperature of 60° C. The results are shown in Table 7 below.

| Electroless gold plating solution (E) | |
|---|---|
| Sodium gold (I) sulfite | 2 g/L as gold |
| Sodium sulfite | 12.5 g/L |
| Sodium thiosulfate | 25 g/L |
| Sodium L-ascorbate | 40 g/L |
| Disodium hydrogen phosphate | 9 g/L |
| Sodium dihydrogen phosphate | 3 g/L |
| pH | 7.0 |

TABLE 7

| | Amount of 2-mercapto-benzoxazole added (ppm) | Deposition rate (μm/hr) | Bath change |
|---|---|---|---|
| Control | 0 | 0.74 | Gold precipitate formed in 2 hrs |
| Example of the present invention | 50 | 0.67 | No precipitate formed during 6 hrs |
| | 100 | 0.72 | No precipitate formed during 6 hrs |
| | 250 | 0.69 | No precipitate formed during 6 hrs |
| | 500 | 0.71 | No precipitate formed during 6 hrs |

As can be seen from Table 7, in the bath containing no 2-mercaptobenzoxazole (control), formation of a small amount of gold precipitate began in about two hours, it thus being difficult to use the bath for six hours or longer.

In contrast, the 2-mercaptobenzoxazole-added baths (examples of the present invention), exhibited remarkably enhanced bath stability with no formation of gold precipitate observed within the six hours of plating. With regard to the gold deposition rate, those baths containing the 2-mercaptobenzoxazole at any indicated concentrations exhibited much the same plating rate as with the additive-free bath (control), thus showing no plating rate reduction with increasing stability.

With regard to the appearance of deposits, the additive-free (control) bath gave a matted deposit which was reddish yellow in color, whereas the deposits obtained in the examples of the present invention presented a better appearance in that they were semi-bright and bright yellow in color.

Example 9

An electroless gold plating bath was prepared by adding 2-mercaptobenzimidazole to an electroless gold plating solution (F) of the composition described below to a concentration of 25 ppm. Using the resultant bath, plating was carried out for six hours with specimens of the same type under the same plating conditions as in Example 7. After being allowed to stand overnight at room temperature, the same (used) bath was used to perform plating all under the same conditions on the following day. These plating operations were performed everyday over an overall period of five consecutive days. As control, plating was performed under the same conditions as described above, using the electroless gold plating solution (F) containing no 2-mercaptobenzimidazole.

| Electroless gold plating solution (F) | |
|---|---|
| Sodium chloroaurate (III) | 2 g/L as gold |
| Sodium sulfite | 15 g/L |
| Sodium thiosulfate | 20 g/L |
| Sodium L-ascorbate | 40 g/L |
| Disodium hydrogen phosphate | 9 g/L |
| Sodium dihydrogen phosphate | 3 g/L |
| pH | 7.0 |

As a result, in the case of the 2-mercaptobenzimidazole-free bath, the six hour-plating on day 1 could be performed at a mean plating rate of 0.85 μm/hr. At a point of time when about three hours had lapsed after the start of plating on day 1, however, a precipitate of fine gold particles was observed to form in the plating solution. Furthermore, the gold precipitate was found to gradually increase during the subsequent overnight standing of the bath at room temperature, and formation of a large amount of precipitate was observed on the following day. Accordingly no plating was possible on and after day 2. In contrast, in the bath to which 25 ppm of 2-mercaptobenzimidazole had been added, no formation of decomposition products such as gold precipitates was observed during the five-day plating and the five-day plating could be successfully carried out, although the daily repeated operation was observed to be accompanied by a decrease in the plating rate on the order of about 10%/day. The mean plating rates during the six-hour platings were 0.85 μm/hr on day 1, 0.77 μm/hr on day 2, 0.72 μm/hr on day 3, 0.66 μm/hr on day 4 and 0.60 μm/hr on day 5. As can be seen from the results of these examples, it has been demonstrated that the incorporation of 2-mercaptobenzimidazole is significantly effective in enhancing the bath stability and also in protecting the bath which has once been heated against formation of decomposition products during its storage, thus rendering possible the long-term repeated use of the bath.

Example 10

An electroless gold plating solution (G) of the composition described below as well as a plating solution consisting of the gold plating solution (G) having 2 ppm of 6-ethoxy-2-mercaptobenzothiazole contained therein was prepared. Each of these plating baths was kept unused at room temperature over the indicated periods of storage in Table 8 shown below.

Using a part of each of the plating solutions kept for the corresponding period of storage, a specimen to be plated, which was obtained by the same treatments as used for the preparation of the specimen in Example 3, was plated for six hours with stirring at a bath load of 0.8 $dm^2/L$ and a temperature of 60° C. The plating solutions kept over the respective periods of storage were compared in respect of the plating rate and the appearance of the finished product. The results are shown in Table 8 below.

| Electroless gold plating solution (G) | |
|---|---|
| Sodium chloroaurate (III) | 2 g/L as gold |
| Sodium sulfite | 12.5 g/L |
| Sodium thiosulfate | 25 g/L |
| Sodium L-ascorbate | 40 g/L |
| Disodium hydrogen phosphate | 9 g/L |
| Sodium dihydrogen phosphate | 3 g/L |
| pH | 7.0 |

TABLE 8

| Composition of solution | Period of storage | Bath change during storage | Plating rate (μm/hr) |
|---|---|---|---|
| | Control | | |
| 6-ethoxy-2 mercapto-benzothiazole-free | Immediately after make up | — | 0.70 |
| | 7 days | Gold precipitate | No plating possible |

TABLE 8-continued

| Composition of solution | Period of storage | Bath change during storage | Plating rate (μm/hr) |
|---|---|---|---|
| | | formed | |
| | Example of the present invention | | |
| 6-ethoxy-2-mercapto-benzothiazole added in an amount of 2 ppm | Immediately after make up | — | 0.76 |
| | 7 days | No precipitate formed | 0.51 |
| | 14 days | No precipitate formed | 0.57 |
| | 21 days | No precipitate formed | 0.51 |
| | 28 days | No precipitate formed | 0.52 |
| | 35 days | Precipitate formed | No plating possible |

As can be seen from Table 8, in the 6-ethoxy- 2-mercaptobenzothiazole-free bath (control), a large amount of gold precipitate formed in the bath already as early as in one week of storage, thus rendering it impossible to perform further plating. In contrast, in the bath to which 2 ppm of 6-ethoxy-2-mercaptobenzothiazole had been added (example of the present invention) no formation of precipitate was observed up until the twenty-eighth day (day 28). Plating with the stored bath showed a slight decrease in the plating rate as compared with the rate achieved with the freshly made up bath, and plating was possible with the baths stored up to 28 days without plating rate differences dependent on days of storage. Thus, with the 35-day-stored bath, a gold precipitate formed so that no normal plating was possible.

Furthermore, plating with the bath containing 6-ethoxy-2-mercaptobenzothiazole at 2 ppm gave bright yellow, matted or semi-bright, uniform deposit films, independently of periods of storage of the plating bath.

Examples 11–14

An electroless gold plating solution (H) of the composition described below was prepared, and ethylenediamine was incorporated into the solution to the different concentrations as indicated in Table 9. Using each of the resultant solutions, a specimen to be plated, which was obtained by electrically plating a rolled nickel plate, 2 cm×2 cm in size and 0.1 mm in thickness, first with a 3 μm-thick nickel film and then with a 3 μm-thick gold film, was plated for six hours with stirring at a bath load of 0.8 $dm^2/L$ and a temperature of 60° C. Plating was also performed under the same conditions as described above using Control (1) where no ethylenediamine was added or Control (2) where the 2-mercaptobenzothiazole was removed from and 300 mg/L of ethylenediamine was added to the solution (H).

The plating solutions containing ethylenediamine at the different concentrations and the Control (1) and (2) solutions were compared in respect of the stability during their storage at room temperature.

| Electroless gold plating solution (H) | |
|---|---|
| Sodium chloroaurate (III) | 2 g/L as gold |
| Sodium sulfite | 10 g/L |
| Sodium thiosulfate | 20 g/L |
| Sodium L-ascorbate | 40 g/L |
| Disodium hydrogen phosphate | 9 g/L |
| Sodium dihydrogen phosphate | 3 g/L |
| 2-mercaptobenzothiazole | 1 ppm |
| pH | 7.0 |

The results of plating performed with each example are shown in FIG. 1. It can be seen that Examples 11–14 where ethylenediamine was added gave a remarkable increase in the plating rate as compared to the rate achieved with Control (1) where no ethylenediamine was added. Furthermore, it was demonstrated that the plating rate increase was dependent upon the concentration of ethylenediamine added, and also that the addition of ethylenediamine in amounts of 300 mg/L or more had a tendency to gradually slow down the degree of such increase. Although there was observed a tendency that the higher the plating rate and hence the more the gold consumption, the lower the deposition rate, thick plating with films of 10 μm or more in thickness was possible in six hours in Examples 13 and 14. In any of the examples, the deposit was found to be in a good state, thus presenting a bright yellow, semi-bright, uniform appearance.

Furthermore, in Examples 11–14, the six-hour plating could be performed with good stability without forming any gold precipitate. In contrast, in Control (2) where no 2-mercaptobenzothiazole but 300 mg/L of ethylenediamine was added, the plating bath was unstable and a gold precipitate began to form about 30 minutes after the make up of the bath, it thus being difficult to perform plating for one hour or longer, although the similar effect of increasing the plating rate to that achieved with the examples of the present invention was also observed.

The results obtained with regard to the storage at room temperature are shown in Table 9. As compared with Control (1) where no ethylenediamine was added, the stability was found to tend to decrease with increasing amounts of ethylenediamine added but was found to be insured at least one week. In the case of Control (2) where no 2-mercaptobenzothiazole was added, a gold precipitate formed as early as at six hours after the make up of the bath.

TABLE 9

| | | Amount of ethylene-diamine added | State of solution |
|---|---|---|---|
| Examples of the present invention | 11 | 60 mg/liter | Gold precipitate formed on day 20 |
| | 12 | 150 mg/liter | Gold precipitate formed on day 10 |
| | 13 | 300 mg/liter | Gold precipitate formed on day 8 |
| | 14 | 600 mg/liter | Gold precipitate formed on day 8 |
| Controls | 1 | Ethylenediamine-free | Gold precipitate formed on day 20 |
| | 2 | Ethylenediamine added in an amount of 300 mg/L 2-mercaptobenzo-thiazole-free | Gold precipitate formed in 6 hrs |

Examples 15–20

Plating baths were prepared by adding to the electroless gold plating solution (H) as described above in Examples 11–14 one of the varied alkylamines indicated in Table 10 to a concentration of 0.01 moles/liter, and tested for the plating rate. Plating was carried out for one hour with stirring at a bath load of 0.8 $dm^2$/L and a temperature of 60° C., using specimens to be plated of the same type as used in Examples 11–14.

The results are shown in Table 10. Any of the alkyl amine-added baths was found to show an increased plating rate as compared with that achieved with the alkyl amine-free control. Furthermore, the deposit obtained in any of the examples of the present invention was found to be in a better state, thus presenting a bright yellow, semi-bright, uniform appearance. In addition no gold precipitate formation was observed during plating operation in any of the examples of the present invention.

TABLE 10

| | | Alkylamine added | Plating film thickness (μm/hr) | State of bath |
|---|---|---|---|---|
| Examples of the present invention | 15 | Diethylamine | 1.5 | No change |
| | 16 | Diethylenetriamine | 3.3 | No change |
| | 17 | Triethylenetetramine | 3.2 | No change |
| | 18 | 1,3-Propanediamine | 2.3 | No change |
| | 19 | Hexamethylene-tetramine | 1.5 | No change |
| | 20 | Triethanolamine | 1.4 | No change |
| Control | | Alkylamine-free | 0.75 | No change |

Example 21

An electroless gold plating solution (I) of the composition described below was prepared. Using the plating solution, a specimen to be plated, which was obtained in the conventional manner by electrically plating a rolled nickel plate, 4 cm×4 cm in size and 0.1 mm in thickness, first with a 3μm-thick nickel film and then with a 3 μm-thick gold film, was plated for two hours with stirring at a temperature of 60° C.

The plating rate-increasing effect of augmenting the bath load of the plating solution from 0.8 to 1.6, to 3.2, and to 6.4 $dm^2$/liter was checked.

Electroless gold plating solution (I)

| | |
|---|---|
| Sodium chloroaurate (III) | 2 g/L as gold |
| Sodium sulfite | 12 g/L |
| Sodium thiosulfate | 24 g/L |
| Sodium L-ascorbate | 40 g/L |
| Disodium hydrogen phosphate | 7 g/L |
| Sodium dihydrogen phosphate | 3 g/L |
| 2-mercaptobenzothiazole, Na salt | 2 ppm |
| Ethylenediamine sulfate | 800 mg/L |
| pH | 7.0 |

The plating rates during plating at the bath loads were 2.7 μm/hr, 2.1 μm/hr. 2.1 μm/hr and 1.8 μm/hr at 0.8 $dm^2$/liter, 1.6 $dm^2$/liter, 3.2 $dm^2$/liter and 6.4 $dm^2$/liter, respectively. Furthermore, the deposit obtained in any of the examples of the present invention was found to be in a better state, thus presenting a bright yellow, semi-bright, uniform appearance. Although a tendency was observed that the plating rate was reduced with increasing bath load, the plating rate-increasing effect of ethylenediamine was still observed even at a bath load of 6.4 $dm^2$/liter and it was possible to plate a number of substrate items within a short period of time.

Example 22

An electroless gold plating solution (J) of the composition described below was prepared and tested for stability during storage at room temperature, plating rate and stability during plating. Plating was performed under the same conditions as described in Examples 11–14. Stability and plating rate were also examined, in the same manner as described above, for the controls, i.e. Controls (1), (2) and (3) consisting of the composition (J) from which had been removed only ethylenediamine, only 2-mercaptobenzimidazole and both the two, respectively. The results are shown in Table 11.

| Electroless gold plating solution (J) | |
|---|---|
| Sodium chloroaurate (III) | 2 g/L as gold |
| Sodium sulfite | 10 g/L |
| Sodium thiosulfate | 20 g/L |
| Sodium L-ascorbate | 40 g/L |
| Disodium hydrogen phosphate | 9 g/L |
| Sodium dihydrogen phosphate | 3 g/L |
| 2-mercaptobenzimidazole | 100 ppm |
| Ethylenediamine | 0.3 g/L |
| pH | 7.2 |

TABLE 11

| | Composition of bath | Plating film thickness (μm/3 hr) | State of bath during plating | State of bath upon standing at room temperature |
|---|---|---|---|---|
| Example 22 | (J) | 4.9 | No precipitate formed during 6 hrs | Gold precipitate formed on day 8 |
| Control (1) | Ethylene-diamine-free | 2.0 | No precipitate formed during 6 hrs | Gold precipitate formed on day 14 |
| Control (2) | 2-mercapto-benzimidazole-free | 3.8 precipitate | Gold tate formed formed in 1 hr | Gold precipi- in 6 hrs |
| Control (3) | Ethylene-diamine- and 2-mercapto-benzimidazole-free | 2.1 | Gold precipitate formed in 3 hrs | Gold precipitate formed on day 2 |

As can be seen from Table 11, where the bath composition (J) as an example of the present invention was used, a higher plating rate than in Controls (1), (2) and (3) was achieved together with good stability during plating and during storage at room temperature. Control (1) where no ethylenediamine was added gave better stability but a lower plating rate than in the example of the present invention and Control (2) where no 2-mercaptobenzimidazole was added gave an increased plating rate but rendered it difficult to continue plating operation because of the bath becoming unstable. Furthermore, Control (3) where neither ethylenediamine nor 2-mercaptobenzimidazole was added gave a low plating rate as well as unsatisfactory results also in respect of stability.

In the example of the present invention as well as in Control (1), the deposit obtained was bright yellow and semi-bright, thus presenting a good appearance. In Control (2), the surface was not in a good state because of gold decomposition products having been deposited thereon. In Control (3), the deposit appearance was reddish yellow in color and matted.

Example 23

An electroless gold plating solution (K) of the composition described below was prepared. This solution was tested for plating rate and stability by performing plating therewith under the same conditions as described in Examples 11–14. Stability and plating rate were also examined, in the same manner as described above, for the controls, i.e. Controls (1), (2) and (3) consisting of the composition (K) from which had been removed diethylenetriamine, 6-ethoxy-2-mercaptobenzothiazole, and both the two, respectively. The results are shown in Table 12.

| Electroless gold plating solution (K) | |
|---|---|
| Sodium gold (I) sulfite | 2 g/L as gold |
| Sodium sulfite | 15 g/L |
| Sodium thiosulfate | 30 g/L |
| Sodium L-ascorbate | 40 g/L |
| Disodium hydrogen phosphate | 12 g/L |
| Sodium dihydrogen phosphate | 4 g/L |
| 6-ethoxy-2-mercaptobenzothiazole | 2.5 ppm |
| Diethylenetriamine | 0.25 g/L |
| pH | 7.2 |

TABLE 12

| | Composition of bath | Plating film thickness (μm/6 hrs) | State of bath during plating |
|---|---|---|---|
| Example 23 | (K) | 4.8 | No gold precipitate formed during 6 hrs |
| Control (1) | Diethylenetriamine-free | 2.3 | No gold precipitate formed during 6 hrs |
| Control (2) | 6-ethoxy-2-mercaptobenzothiazole-free | 4.5 | Gold precipitate formed in 3 hrs |
| Control (3) | Diethylenetriamine- and 6-ethoxy-2-mercaptobenzothiazole-free | 3.0 | Gold precipitate formed in 3 hrs |

As can be seen from Table 12, where the bath composition (K) as an example of the present invention was used, a higher plating rate than in Controls (1), (2) and (3) was achieved together with good stability during plating. In Control (1) where no diethylenetriamine was added was observed a significantly decreased plating rate although the stability was shown to be as good as in the example of the present invention. In Control (2) where no 6-ethoxy-2-mercaptobenzothiazole was added, an increased plating rate was obtained but the concomitant instabilization of the bath rendered it difficult to continue further plating operation. In Control (3) where neither diethylenetriamine nor 6-ethoxy-2-mercaptobenzothiazole was added, the plating rate was low and the bath stability was inadequate. The appearance of the deposit in Control (1) was reddish yellow in color and matted and in Controls (2) and (3) the surface was not in a good state because of gold decomposition products having been deposited thereon. In contrast, the deposit obtained in the example of the present invention was bright yellow and semig-bright, thus presenting the best appearance.

Examples 24–26

Plating was carried out using those plating solutions of the respective compositions as indicated in the columns for Examples 24–26 of Table 13. Plating was likewise conducted using as controls those solutions prepared by removing the alkylamine compounds from the respective compositions. The plating was carried out by using specimens to be plated of the same type as in Examples 11–14 and subjecting them to a three-hour immersion treatment with stirring at a temperature of 60° C.

As can be seen from Table 13, addition of the alkylamines in the examples of the present invention was found to cause a remarkable increase in the plating rate. In Examples 24 and 26, there were additionally used thallium and lead salts, respectively, which are known to be grain refiners for gold plating deposits, but the plating rate-increasing effect of the alkylamines added and the bath-stabilizing effect of the mercapto compound added were not affected.

TABLE 13

| | Example 24 | Example 25 | Example 26 |
|---|---|---|---|
| Composition (g/liter) | | | |
| Sodium chloroaurate (III) | 2 (as gold) | | 2 (as gold) |
| Sodium gold (I) sulfite | | 2 (as gold) | |
| Sodium sulfite | 20 | 12.5 | 10 |
| Sodium thiosulfate | 20 | 25 | 20 |
| Disodium hydrogen phosphate | 9 | 9 | 9 |
| Sodium dihydrogen phosphate | 3 | 3 | 3 |
| Sodium L-ascorbate | 40 | 40 | 40 |
| 2-mercaptobenzothiazole | 1 ppm | | 2 ppm |
| 2-mercaptobenzoxazole | | 50 ppm | |
| Ethylenediamine sulfate | 0.8 | | |
| 1,3-propanediamine | | 0.37 | |
| Triethylenetetramine | | | 0.3 |
| Thallium sulfate | 200 ppb | | |
| Lead acetate | | | 1 ppm |
| pH | 7.3 | 7.1 | 6.8 |
| Deposition rate (μm/3 hrs) | 4.2 | 5.0 | 6.4 |
| State of bath | No gold precipitate formed | No gold precipitate formed | No gold precipitate formed |
| Control (amine-free): Plating rate (μm/3 hrs) | 2.1 | 2.0 | 2.5 |

[Advantageous Effects of the Invention]

The electroless gold plating solution of the present invention exhibits extremely high stability and therefore prevents the bath made up thereof from forming any precipitate during the storage and use of the bath. The plating bath can be stably used for long periods of time and repeatedly used in plating. Thus, whereas the hitherto known gold plating baths have the drawback of having to use them immediately after their make up, the bath of the present invention has the excellent advantage that there are no restrictions with regard to operation times.

Furthermore, the electroless gold plating solution of the present invention where alkylamine compounds were additionally added also exhibits an improvement with regard to the plating rate, a problematic point associated with the use of conventional electroless gold plating solutions. Thus it is characterized by a significantly high plating rate, which does not decrease even at high bath loads. This leads to the excellent advantage that a number of substrate items can be plated within a short period of time. Furthermore, due to the sustainable high plating rate, thick plating can be completed within a relatively short period of time.

Figure 1:
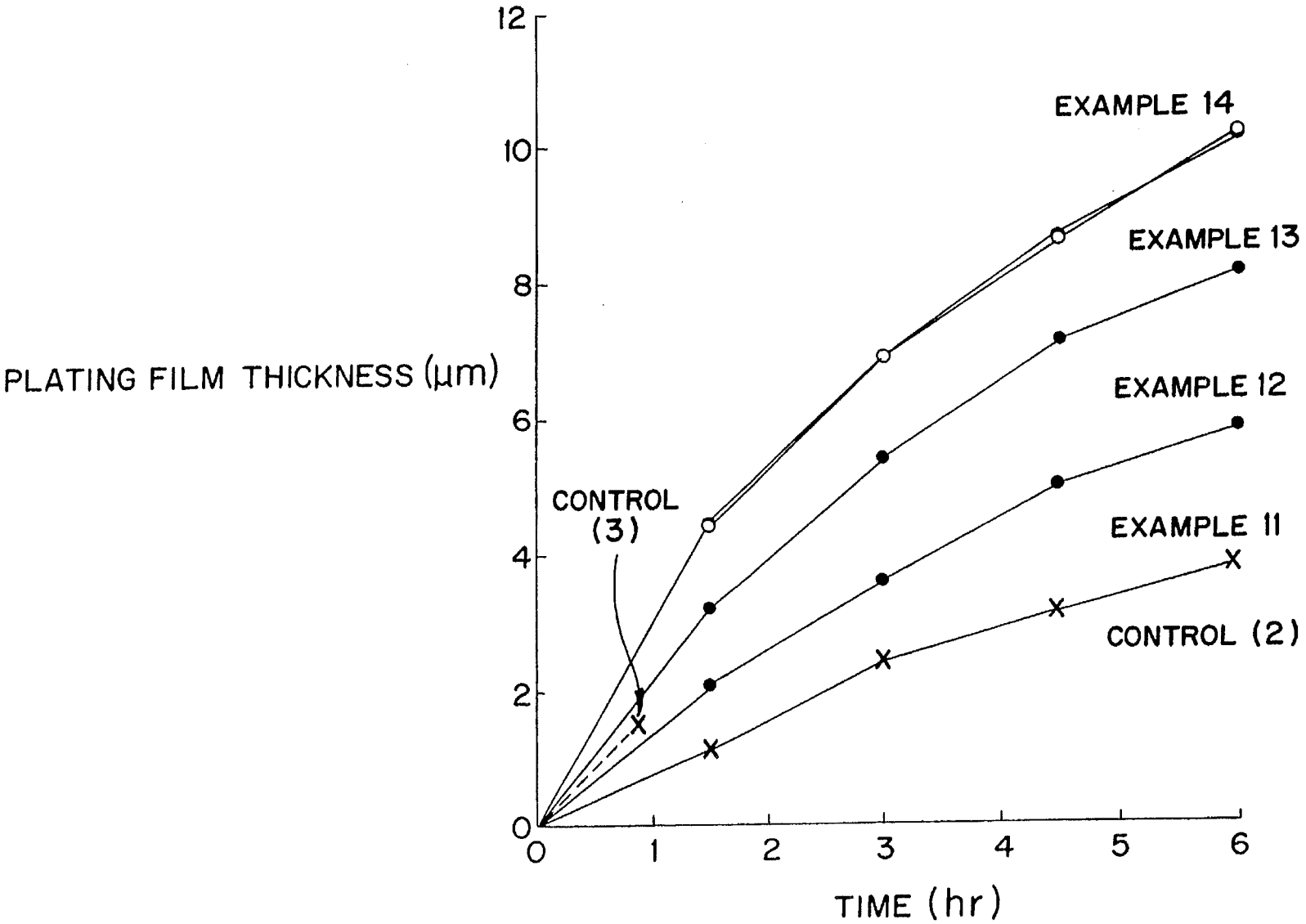
FIG. 1 shows a diagram of the comparison between the results obtained from Examples 11–14 and Controls (2) and (3) wherein the plating film thickness (μm) obtained is plotted along the ordinate and the plating time (hr) along the abocissa.

We claim:

1. An electroless gold plating solution comprising an aqueous solution which comprises: chloroauric (III) acid or a salt thereof or a sulfite or thiosulfate gold (I) complex salt as a gold source, an alkali metal or ammonium sulfite or thiosulfate, ascorbic acid or a salt thereof, a pH buffer, and a compound selected from the group consisting of 2-mercaptobenzothiazole, 6-ethoxy-2-mercaptobenzothiazole, 2-mercaptobenzimidazole, 2-mercaptobenzoxazole and salts thereof.

2. The electroless gold plating solution as claimed in claim 1, further comprising an alkylamine compound or a sulfate or hydrochloride thereof.

3. The electroless gold plating solution as claimed in claim 1, which contains 0.001–0.10 mole/L of said gold source, 0.01–1.0 mole/L of said alkali metal or ammonium sulfite or thiosulfite, 0.001–1.0 mole/L of said ascorbic acid or salt thereof, 0.01–1.0 mole/L of said pH buffer and $6\times10^{-7}$–$3\times10^{-3}$ mole/L of said compound selected from the group consisting of 2-mercaptobenzothiazole, 6-ethoxy-2-mercaptobenzothiazole, 2-mercaptobenzimidazole, 2-mercaptobenzoxazole and salts thereof.

4. The electroless gold plating solution as claimed in claim 3, further comprising 0.0001–0.05 mole/L of an alkylamine compound or a sulfate or hydrochloride thereof.

5. The electroless gold plating solution as claimed in claim 1, wherein the pH of the solution is from 5–9.

6. The electroless gold plating solution as claimed in claim 5, wherein the pH of the solution is from 6–8.

7. An electroless gold plating solution comprising an aqueous solution which comprises: chloroauric (III) acid or a salt thereof or a sulfite or thiosulfate gold (I) complex salt as a gold source, an alkali metal or ammonium sulfite or thiosulfate, ascorbic acid or a salt thereof, a pH buffer, a compound selected from the group consisting of 2-mercaptobenzothiazole, 6-ethoxy-2-mercaptobenzothiazole, 2-mercaptobenzimidazole, 2-mercaptobenzoxazole and salts thereof, and an alkylamine compound or the sulfates or hydrochloride thereof.

* * * * *